US006604920B1

(12) United States Patent
Lishanski et al.

(10) Patent No.: US 6,604,920 B1
(45) Date of Patent: Aug. 12, 2003

(54) VIBRATORY PUMP

(76) Inventors: Grigori Lishanski, 10112 W. Sharon La., Milwaukee, WI (US) 52225; Oleg Lishanski, 805 Weidner Ct., Buffalo Grove, IL (US) 60089

( * ) Notice: Subject to any disclaimer, the term of this patent is extended or adjusted under 35 U.S.C. 154(b) by 0 days.

(21) Appl. No.: 09/825,519

(22) Filed: Apr. 3, 2001

(51) Int. Cl.[7] ..... F04B 39/10
(52) U.S. Cl. ..... 417/491; 417/531
(58) Field of Search ..... 417/491, 415, 417/534, 442, 493, 531

(56) References Cited

U.S. PATENT DOCUMENTS

| | | | | | |
|---|---|---|---|---|---|
| 10,255 | A | * | 11/1853 | Worthen | 221/255 |
| 475,296 | A | * | 5/1892 | Chamberlin | 417/491 |
| 1,529,384 | A | * | 3/1925 | Adams | 417/531 |
| 2,038,155 | A | * | 4/1936 | Aldridge | 417/491 |
| 4,755,194 | A | * | 7/1988 | Rooker et al. | 95/258 |
| 5,147,535 | A | * | 9/1992 | Bernhardt | 166/177.6 |

FOREIGN PATENT DOCUMENTS

| | | | | |
|---|---|---|---|---|
| CN | 1076255 | A | * 9/1993 | 417/423.1 |

* cited by examiner

*Primary Examiner*—Cheryl J. Tyler
(74) *Attorney, Agent, or Firm*—Boyle Fredrickson Newholm Stein & Gratz S.C.

(57) ABSTRACT

A vibratory pump includes an oscillator that is connected to a plunger mounted within a housing submerged beneath the surface of a fluid to be displaced. The oscillations of the plunger selectively communicate an outlet for the pump with inlet openings on the housing. The selective communication creates a slight vacuum in the pump that enables the fluid to be moved by the pump without generating any significant back pressure in the outlet fluid flow from the pump. The pump can also be configured to operate in a dual stroke mode where an outward flow of fluid from the pump is generated during both the downward and return strokes of the pump.

15 Claims, 2 Drawing Sheets

VIBRATORY PUMP

FIELD AND BACKGROUND OF THE INVENTION

The present invention relates to pumps, and in particular to a vibratory pump that can be widely used in different branches of industry, in scientific research, in medicine and in agriculture production.

When fluids are to be moved from one place or container to another, a pump is normnally used. The wide variety of pumps available can very adequately move the fluid using mechanical forces generated by the pump. However, these pumps cannot adequately move precise volumes of fluid due the presence of back pressure in the fluid lines of the pump. This back pressure is created by the force of the fluid flowing through the pump, and causes the fluid being pumped to continue to flow for a period of time after the pump has stopped operating.

Therefore it is desirable to develop a type of pump which is capable of moving large volumes of fluid from one location to another without creating any back pressure within the pump itself. A pump having this capability would be highly useful in situations where the volume of fluid to be moved must be extremely precise, such as in various medical applications.

SUMMARY OF THE INVENTION

It is an object of the present invention to provide a pump operated by a vibration generator that does mot create any back pressure in the fluid flow when the pump is in operation.

It is another object of the invention to provide a pump which can deliver a fluid in a wide range of volumes by varying the frequency of the vibration generator driving the pump.

It is still another object of the invention to provide a pump that can provide a fluid flow out of the fluid lines of the pump during both the downward and upward strokes of the pump.

It is still a further object of the invention to provide a pump capable of combining the fluid flow generated during both strokes of the pump into a single fluid flow.

The present invention is a pump operated by a vibration generator connected to the pump. The pump includes a plunger slidably disposed within a housing having a number of fluid openings. The fluid openings allow the fluid to be pumped to enter the interior of the housing. A shaft connects the plunger to the vibration generator to enable the pump to move in conjunction with the oscillations of the vibration generator. The vibration generator causes the shaft and plunger to move a short distance in order to create the pumping action for the apparatus.

The plunger is in fluid communication with an outlet on the housing and also includes a number of fluid openings that enable the fluid entering the housing to flow into the plunger. The oscillation of the plunger within the housing successively fills the plunger with fluid and forces the fluid out of the outlet of the housing.

The small travel length of the plunger in the housing creates no back pressure in the fluid passing through the pump. This enables the fluid flow generated by the pump to stop instantaneously with the shutting off of the pump. Furthermore, because the vibration generator is controlled by a variably operable power source, it is possible to change the output of the pump of the present invention over a wide range of operational parameters to control the flow rate based upon the particular application to which the pump is put.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
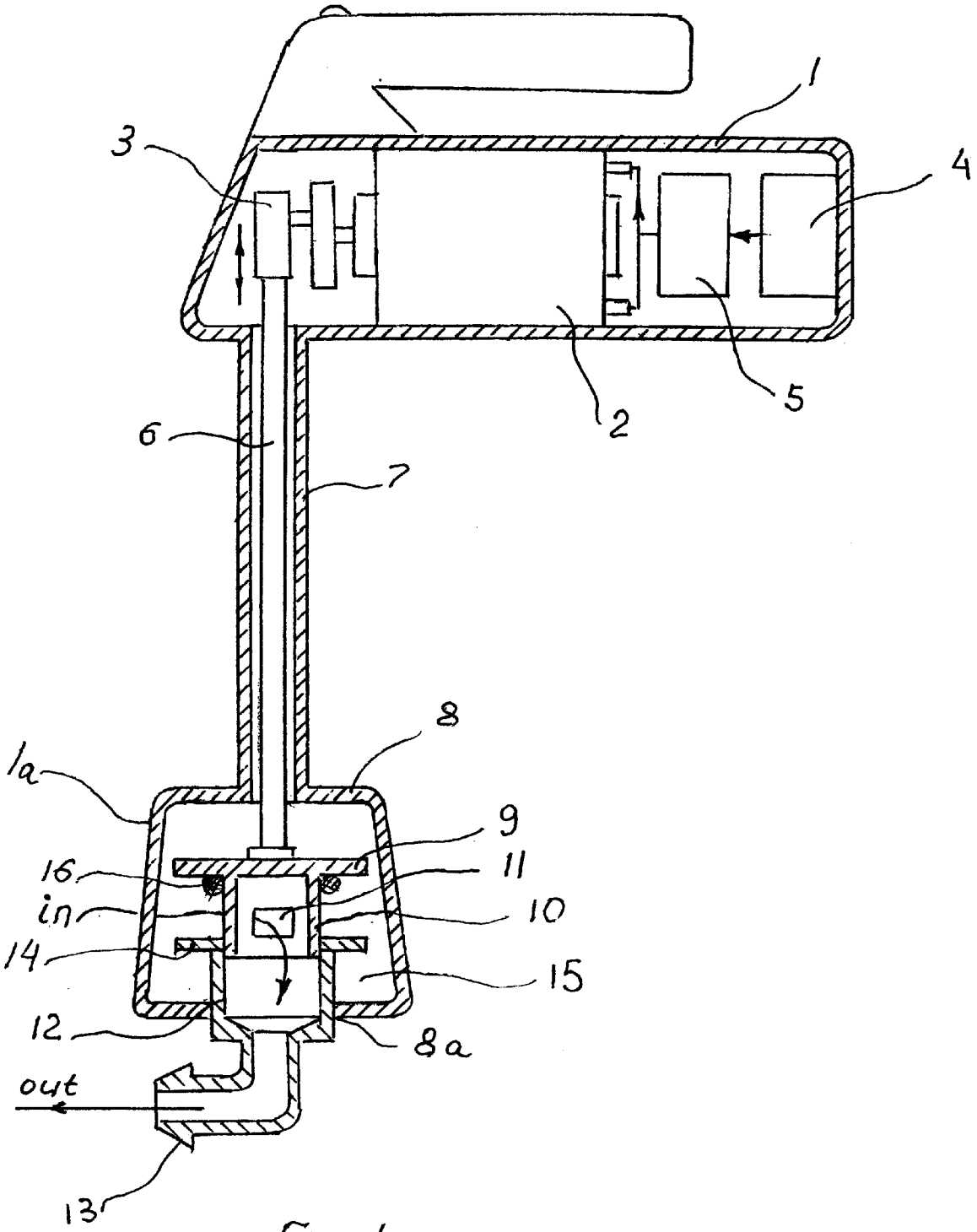
FIG. 1 is a cross-sectional view of a pump apparatus constructed according to the present invention.

With reference now to the drawing figures in which like reference numerals designate like parts throughout the disclosure, a pump is designated generally at 1 in FIG. 1. The pump 1 includes a pump body 1 a that encloses an electric motor 2 that is connected to a converting mechanism 3 which converts the rotary motion of the electric motor 2 into the reciprocating motion necessary for the operating elements of a vibratory pump. In a preferred embodiment the mechanism 3 is a circular cam, but can be any suitable device. The electric motor 2 is powered by a conventional power supply 4, such as a DC or AC power source. The power supply 4 is connected to the motor 2 through an electronic current controller 5 which can be used to control the operating speed of the electric motor 2, and consequently to control the frequency of the oscillations of the converting mechanism 3 connected to the motor 2.

Opposite the motor 2, the converting mechanism 3 is connected to the upper end of a shaft 6 which is disposed within a tube 7 interconnected with the body 1*a*. The shaft 6 is formed of a rigid material such as a hard plastic or a metal, e.g., steel, aluminum, titanium, polyvinyl chloride, polyester, or any other suitable material. The tube 7 is fixed to the body 1*a* such that the shaft moves relative to the tube 7 when the pump 1 is in operation.

Opposite the body 1 a the tube 7 is fixedly connected to a housing 8. The housing 8 is generally square in shape, but can have any form desired. The body 1*a*, the tube 7 and the housing 8 are preferably formed of the same material, which is a rigid, waterproof material resistant to most acidic and basic substances to enable the pump 1 to pump corrosive fluids.

The housing 8 has an upper wall, a lower wall and a number of side walls, and includes a pair of openings 15 in opposed side walls of the housing 8. The opening 15 allow fluid to enter into the interior of the housing. While the housing 8 is illustrated as having a pair of opposed openings 15, it should be noted that the number of openings in the housing can be varied from as few as one, to as many as are deemed necessary to enable the proper amount of fluid to enter the housing. The lower wall of the housing 8 has an outlet opening 8a in which is disposed a hollow cylindrical chamber 12. The chamber 12 defines an outlet for the fluid that has entered the housing 8 and includes a peripheral flange 14 around an inlet end disposed within the housing 8, and an outlet tube 13 forming an outlet end outside of the housing 8 opposite the flange 14. The outlet tube 13 can be connected to a length of hose (not shown) in order to direct the outlet flow of fluid to the desired location.

The pump also includes a cylindrical plunger 10 disposed within the housing 8 and slidably engagable with the chamber 12. The plunger 10 has an outer diameter slightly lees than the inner diameter of the chamber 12, i.e. between 0.0 and 0.25 mm smaller, to allow the plunger to slide freely within the chamber 12. The plunger 10 also has a closed upper end and an open lower end. The upper end is formed by a plate 9 extending across the upper end of the plunger and forming a peripheral flange around the upper end of the plunger 10. The shaft 6 is secured to the plate 9 to enable the plunger 10 to move in conjunction with the oscillating movements of the shaft 6 and converting mechanism 3. When the shaft 6 has raised the plunger 10 to its highest point within the housing 8, the open end of the plunger 10 is positioned partially within the chamber 12, at least 4 mm below the inlet end of the chamber 12, to ensure that the plunger 10 remains in proper alignment with the chamber 12 while the pump 1 is in operation.

Between the plate 9 and the open end, the plunger 10 also includes a number of fluid passages 11 that enable the fluid inside the housing 8 to enter the plunger 10 when the plunger 10 is raised above the chamber 12. When the plunger 10 is urged downwardly into the chamber 12, the passages 11 are closed and the fluid is pushed out of the plunger 10 and into the chamber 12. To sealingly engage the flange 14 on the chamber 12 when the plunger 10 is fully positioned within the chamber 12 and prevent fluid from flowing out of the chamber 12 past the plunger 10, a sealing member 16, such as a rubber O-ring, is positioned against the plate 9 to engage the flange 14 when the plunger 10 is fully inserted into the chamber 12.

To operate the pump 1, the housing 8 is placed within a volume of the fluid to be pumped. The power supply 4 is then switched on and the voltage is transmitted to the electronic voltage controller 5 which is connected to the electric motor 2. The controller 5 makes it possible to control the revolutions of the motor 2 by controlling the voltage reaching the motor 2. Typically, the motor 2 is operated in the range of from between ten (10) to one hundred and fifty (150) Hz. Any increase of the frequency of the oscillations of the cylinder 10 provides an increase of the volume output of the pump 1. Also, an increase of head characteristics of the pump 1 can be provided by an increase of the length of the motion of the plunger 10.

The rotation of the motor 2 is transferred to the converting mechanism 3 which changes the rotary motion of the electric motor into the reciprocating motion of the shaft 6. The oscillations of the shaft 6, in turn, urge the plunger 10 to move in a reciprocating fashion inside a chamber 12. When the plunger 10 moves upwardly, the passage 11 is exposed and fluid contained within the housing 8 flows into the plunger 10 through the passage 11. The plunger 10 is then urged downwardly into the chamber 12. The length of the downward motion of the plunger 10 is slightly greater than the length of the passage 11 to ensure that the entire passage 11 is covered by the chamber 12. As the passage 11 is covered by the chamber 12, the fluid contained within the plunger 10 is directed into the chamber 12 and through the outlet end 13 for displacement. When the passage 11 is again exposed as the plunger 10 begins to move upwardly, a slight vacuum is formed within the plunger 10 by the absence of the fluid in the plunger 10 that causes more fluid to enter the plunger 10 through the passage 11. The flanges 9 and 14 assist in the creation of an area of low pressure in the liquid surrounding the plunger 10 at the moment the passage 11 is first exposed.

This small vacuum and the weight of the fluid in the container are the only forces acting to create any back pressure in the pump 1. As a result, the back pressure in the pump 1 is negligible, such that when the motor 2 or power source 4 is switched off, the flow of fluid through the outlet 13 ceases immediately.

Figure 2:
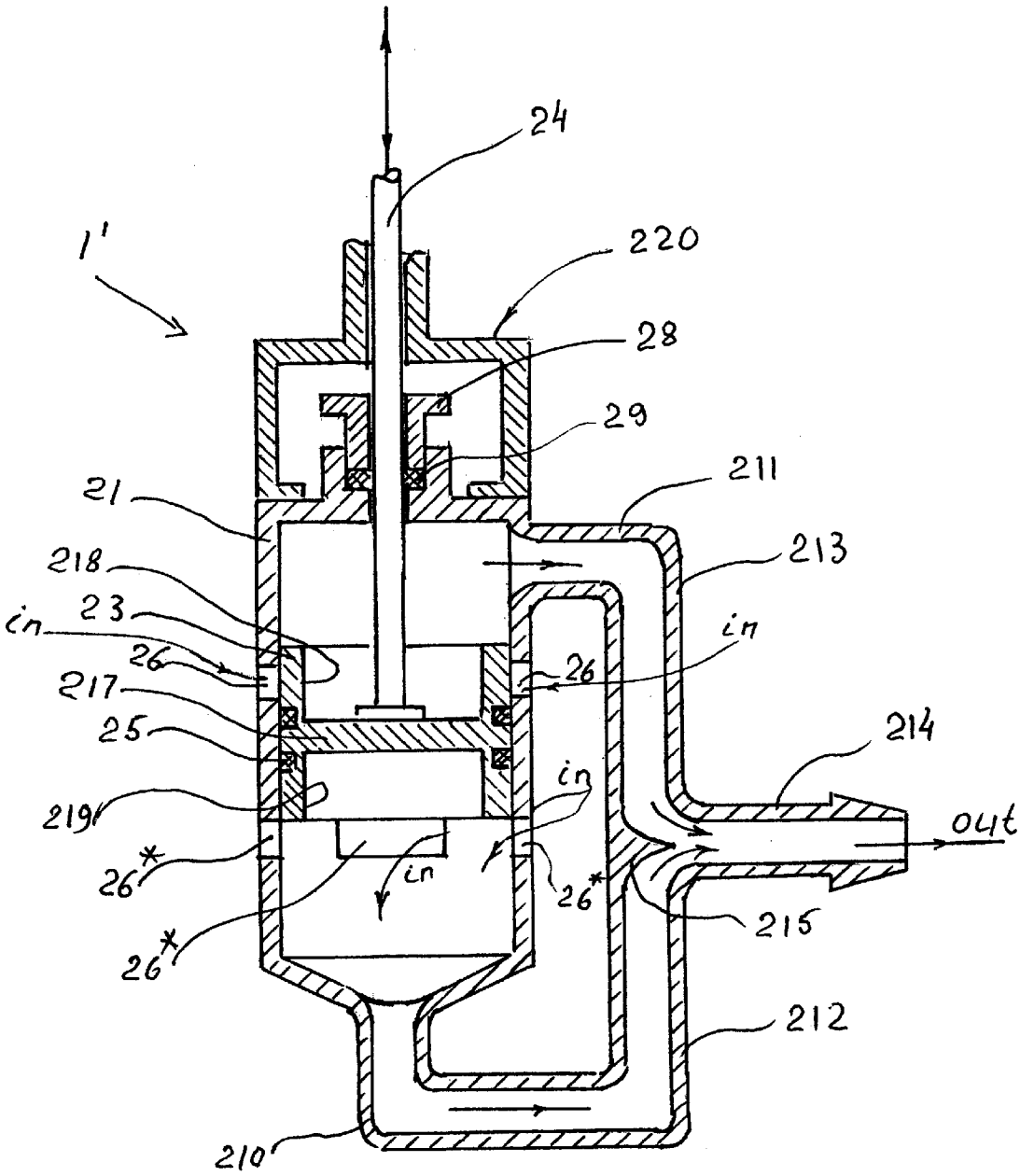
FIG. 2 is a cross-sectional view similar to FIG. 1 of a second embodiment of the present invention.

A second embodiment of the pump 1' of the present invention is presented in FIG. 2. This second embodiment has a volume output capacity twice as large as the pump 1 of FIG. 1 due to the transformation of the return stroke of the plunger inside a fixed chamber into a working stroke. The pump 1 includes a housing 21 having an upper end and a lower end that has two sets of input holes 26 and 26* through which fluid disposed around the housing 21 can flow into the interior of the housing 21.

The housing 21 also has a pair of outlet openings disposed adjacent the up per end and at the lower end, respectively. Each outlet opening is connected to an inlet leg 210 and 211 of an outlet tube The inlet legs 210 and 211 are each connected to an outlet leg 212 and 213, respectively, that are, in turn, connected to a collector 214 opposite the inlet legs. The collector 214 includes a fluid wedge 215 that diverts the outgoing fluid streams in each outlet leg 212 and 213 in such a manner as to greatly reduce the pressure of these fluid streams on one another.

To direct the fluid from the interior of the housing 21 into the outlet openings, a piston or plunger 23 is disposed within the housing 21. The plunger 23 conforms to the shape of the housing 21 and has an outer diameter slightly less than the inner diameter of the housing 21. This enables the plunger 23 to slide freely within the interior of the housing 21. The plunger 23 is generally hollow and has a plate 217 extending across the inside of the plunger 23 at approximately the midpoint of the plunger 23 to define an upper cavity 218 and a lower cavity 219 on opposite sides of the plate 217.

The plate 217 is also connected to one end of a shaft 24 disposed within the upper cavity 218. The shaft 24 is connected to a converting mechanism (not shown) and motor (not shown) similar to that illustrated in FIG. 1 as is used to oscillate the plunger 23 within the housing 21. The shaft 24 passes through a shaft opening in the housing 23 which is sealed by a sealing member 28 and plug 29 disposed around the shaft 24 above the housing 21. The sealing member 28 is formed similarly to the O-rings described with respect to FIG. 1 and are enclosed with the plug 29 inside an enclosure 220 which enhances the sealing ability of the member 28 and plug 29.

The plunger 23 also has a pair of sealing members 25 disposed within circumferential grooves opposite the plate 217 and adjacent each end of the plunger 23. The members 25 are preferably rubber O-rings that serve to prevent any fluid from flowing between the inside of the hosing 21 and the outside of the plunger 23 while the pump 1' is in operation.

The length of the plunger 23 is equal to the length between the lower edge of the upper set of openings 26 and the lower edge of the lower set of openings 26* plus four (4) mm. Therefore, when the plunger 23 is positioned at the extremes of its oscillation, i.e., the top or bottom of the housing 21, the plunger closes one set of openings 26 or 26* and opens the opposite set. This allows fluid to flow into the portion of the housing 21 in fluid communication with the unobstructed openings, and prevents fluid from entering the remainder of the housing 21.

In operation, the housing 21 is placed within a volume of fluid to be displaced and the motor and converting mechanism are turned on and cause the shaft 24 to oscillate up and down a predetermined distance. The oscillation of the shaft 24 also causes the plunger 23 to oscillate the same distance within the housing 21. At the highest point in the oscillation, the plunger 23 completely obstructs the upper set of openings 26 and completely opens the lower set 26*. This allows the fluid surrounding the housing 21 to enter into the interior of the housing 21 through the openings 26* and fill the lower cavity 219. When the plunger 23 begins to move downwardly in response to the oscillation of the shaft 24, the fluid contained within the cavity 219 is urged outwardly from the housing 21 into the inlet leg 210 at the bottom of the housing 21. Simultaneously, the openings 26* are closed and the openings 26 are opened by the plunger 23. This prevents any more fluid from entering the lower cavity 219 and creates a small vacuum around the openings 26 such that fluid enters and fills the upper cavity 218. The plunger 23 then moves upwardly, urging the fluid filling the upper cavity 218 out of the housing 21 and into the inlet leg 211. The upward movement of the plunger 23 also closes the openings 26 and opens the openings 26* to create a small vacuum around the opening 26* and again fill the lower cavity 219, as occurred previously. The oscillation of the plunger 23 within the housing continually opens and closes the respective openings 26 and 26* to provide an outward flow of fluid regardless of the direction in which the plunger 23 is moving, effectively doubling the volume output for the pump 1'.

Similar to the first embodiment, the head capacity and flow rate characteristics of the pump 1' can be controlled by controlling the frequency of the oscillations for the plunger and the length of its working stroke. These characteristics can also be altered by changing the overall dimension of the operating elements of the pump 1' or the power characteristics of the electric motor and/or oscillator, such as by changing the voltage supplied to the motor. Furthermore, as with the first embodiment, only the small vacuum and the weight of the fluid create any back pressure on the output fluid flow, which is negligible.

Various alternatives and embodiments are contemplated as being within the scope of the following claims particularly pointing out and distinctly claiming the subject matter regarded as the invention.

We claims:

1. A dual action pumping apparatus adapted to be attached to a vibration generator, an apparatus comprising:

a housing including an upper end, a lower end and two spaced sets of fluid openings disposed between and adjacent to each end;

an outlet tube having a pair of inlet legs, each inlet leg secured to the housing adjacent one of the upper end or lower end, an outlet leg secured to each of the inlet legs opposite the housing, and a collector joining each of the outlet legs opposite the inlet legs, wherein the collector does not include a valve; and a plunger having top end and bottom end, that is slidably disposed within the housing and attachable to the vibration generator, a plunger capable of alternately obstructing one set of openings in the housing to pump a fluid in which the apparatus is summersed through the inlet leg positioned adjacent the obstructed openings and to open the remaining set of openings to enable fluid to flow into the housing to be pumped.

2. The apparatus of claim 1 further comprising a shaft to the plunger and extending through bore in the upper end of the housing, the shaft connectable to the vibration generator.

3. The apparatus of claim 2 further comprising a seal disposed around the shaft and abutting the bore in the upper end of the housing to prevent fluid from passing through the bore.

4. The apparatus of claim 1 wherein the plunger has a generally hollow interior and includes a plate extending across the interior parallel to the top and bottom ends of the plunger, the plate defining upper and lower cavities within the plunger.

5. The apparatus of claim 4 wherein the plunger includes a pair of exterior channels exposed opposite the plate adjacent to each end of the plunger, each channel containing a compressible sealing member engagable with the housing.

6. The apparatus of claim 1 wherein each set of fluid openings includes at least two openings.

7. The apparatus of claim 1 wherein the collector includes a fluid wedge to direct the fluid flowing from the outlet legs into the collector.

8. A pump apparatus connectable to a vibration generator for pumping a fluid, the apparatus comprising;

an enclosed housing having an upper end and a lower end, a shaft opening disposed in the upper end, a chamber opening disposed in the lower end, and a plurality of fluid openings disposed between the upper and lower ends;

a chamber disposed in the chamber opening and including an inlet end within the housing and an outlet end opposite the inlet end;

a plunger disposed within the housing a slidably mounted to the chamber, the plunger including an open end position within the chamber and a closed end opposite the open end, and at least one fluid passage disposed between the open and closed ends;

a sealing member disposed around the plunger adjacent the closed end and engageable with the inlet end of the inlet end of the chamber;

a shaft connected to the closed end of the plunger that extends through the shaft opening in the housing and is adapted to be connected to the vibration generator.

9. The apparatus of claim 8 wherein the plunger has an outer dimension slightly less that the inner dimension of the chamber.

10. The apparatus of claim 8 wherein the plunger includes a peripheral flange extending outwardly from the closed end that retains the sealing member and on the plunger.

11. A method for pumping a fluid comprising the steps of:

a) providing a pump apparatus including a housing having an upper end and a lower end joined by at least one side wall, the upper end including a shaft opening, the lower end including a first fluid outlet, at least one first fluid opening in fluid communication with the first fluid outlet, a plunger disposed within the housing, the plunger slidably mounted with respect to the housing and having an open end adjacent the outlet, and a closed end opposite the open end, and a shaft connected to the closed end of the plunger and extending through the shaft opening;

b) connecting a vibration generator to the shaft;

c) placing the apparatus in an amount of fluid to be pumped; and d) engaging the vibration generator to enable the plunger to selectively obstruct and expose the at lest one first fluid opening.

12. The method of claim 11 wherein the plunger is positioned within an outlet chamber disposed in the outlet.

13. The method of claim 11 wherein the housing includes a second fluid outlet located adjacent the upper end, and the at least one fluid opening comprises two spaced sets of openings adjacent to each end of the housing.

14. The method of claim 13 wherein the plungers generally hollow and includes a plate extending across the plunger between the top and bottom ends to define upper and lower cavities within the plunger.

15. The method of claim 11 wherein the at least one first fluid opening is disposed in the plunger.

* * * * *